US007710222B2

(12) United States Patent
Koizumi et al.

(10) Patent No.: US 7,710,222 B2
(45) Date of Patent: May 4, 2010

(54) DUAL BAND RESONATOR AND DUAL BAND FILTER

(75) Inventors: Daisuke Koizumi, Zushi (JP); Kei Satoh, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 160 days.

(21) Appl. No.: 12/118,114

(22) Filed: May 9, 2008

(65) Prior Publication Data

US 2008/0278265 A1 Nov. 13, 2008

(30) Foreign Application Priority Data

May 10, 2007 (JP) ..... 2007-125721

(51) Int. Cl.
*H01P 1/203* (2006.01)
*H01P 3/08* (2006.01)

(52) U.S. Cl. ..... 333/204; 333/219

(58) Field of Classification Search ..... 333/202, 333/204, 219, 219.1
See application file for complete search history.

(56) References Cited

U.S. PATENT DOCUMENTS 7,102,470 B2 * 9/2006 Chang et al. ..... 333/204
7,276,995 B2 * 10/2007 Hamada et al. ..... 333/204
7,378,924 B2 * 5/2008 Koizumi et al. ..... 333/204
7,397,331 B2 * 7/2008 Koizumi et al. ..... 333/204
2009/0212886 A1 * 8/2009 Satoh et al. ..... 333/204

FOREIGN PATENT DOCUMENTS

EP 0 084 854 A2 8/1983
EP 1 691 443 A1 8/2006
EP 1 760 823 A1 3/2007

OTHER PUBLICATIONS

Khelifa Hettak, et al., "A Class of Novel Uniplanar Series Resonators and Their Implementation in Original Applications", IEEE Transactions on Microwave Theory and Techniques, vol. 46, No. 9., Sep. 1, 1998, XP011037262, pp. 1270-1276.
Shau-Gang Mao, et al., "Design of Composite Right/Left-Handed Coplanar-Waveguide Bandpass and Dual-Passband Filters", IEEE Transactions on Microwave Theory and Techniques, vol. 54, No. 9, Sep. 2006, XP002484391, pp. 3543-3549.

(Continued)

*Primary Examiner*—Dean O Takaoka
(74) *Attorney, Agent, or Firm*—Oblon, Spivak, McClelland, Maier & Neustadt, L.L.P.

(57) ABSTRACT

A signal input/output line 101 is used for input and output of a signal. A first resonating part 102 is connected to the signal input/output line 101 at one end and is opened at the other end. A second resonating part 103 is connected to a ground conductor 105 at one end and is opened at the other end. A connecting line 104 has a predetermined length and is connected to a point of connection between the signal input/output line 101 and the first resonating part 102 at one end and is connected to a predetermined point on the second resonating part 103 at the other end.

10 Claims, 14 Drawing Sheets

OTHER PUBLICATIONS

Shoichi Kitazawa, et al., "Very Compact Capacitive-Gap-Coupled Bandpass Filters Using Tapped $A_{go}/4$ Coplanar Waveguide Resonators", $24^{th}$ European Microwave Conference Proceedings. Cannes, Sep. 5-8, 1994. vol. 1, XP000643203, pp. 493-498.

Sheng Sun et al. "Novel Design of Microstrip Bandpass Filters with a Controllable Dual-Passband Response:Description and Implementation," lEICE Trans. Electron., vol. E89-C, No. 2, Feb. 2006, pp. 197-202.

Xuehui Guan et al., "Synthesizing Microstrip Dual-Band Bandpass Filters Using Frequency Transformation and Circuit Conversion Technique", lEICE Trans. Electron., vol. E89-C, No. 4, Apr. 2006, pp. 495-502.

* cited by examiner

DUAL BAND RESONATOR AND DUAL BAND FILTER

TECHNICAL FIELD

The present invention relates to a dual band resonator and a dual band filter mainly used for a plane circuit for the microwave band or millimeter wave band.

BACKGROUND ART

In general, conventional dual band filters having two pass bands can be classified into two types in terms of configuration.

One type is a filter composed of dual band resonators that have an appearance of one integral unit, resonate at two frequencies and are coupled to the input/output ports and further dual band resonators coupled thereto, such as the filter shown in FIG. 14 (see the non-patent literature 1, for example). For this filter, the structure and the dimensions of the coupling parts of the dual band resonators disposed at the opposite ends and coupled to the input/output line have to be determined to achieve a desired center frequency and a desired bandwidth for each of the two bands.

The other type is a filter composed of a plurality of transmission lines having different impedances and different lengths connected at the respective ends to each other, such as the filter shown in FIG. 15 (see the non-patent literature 2, for example). For this filter, the characteristics of a dual band filter are achieved by determining the characteristic impedance and the length of each transmission line based on the equivalent circuit theory using lumped elements.

Non-patent literature 1: S. Sun, L. Zhu, "Novel Design of Microstrip Bandpass Filters with a Controllable Dual-Passband Response: Description and Implementation," IEICE Trans. Electron., vol. E89-C, no. 2, pp. 197-202, February 2006

Non-patent literature 2: X. Guan, Z. Ma, P. Cai, Y. Kobayashi, T. Anada, and G. Hagiwara, "Synthesizing Microstrip Dual-Band Bandpass Filters Using Frequency Transformation and Circuit Conversion Technique", IEICE Trans. Electron., vol. E89-C, no. 4, pp. 495-502, April 2006

DISCLOSURE OF THE INVENTION

Issues to be Solved by the Invention

For a typical dual band filter, a center frequency and a bandwidth have to be set for each of the two pass bands, and therefore, a total of four characteristic values have to be controlled. However, for the dual band filter shown in FIG. 14, the four characteristic values have to be controlled by adjusting the structure and dimensions of a single part. Therefore, in designing and constructing the dual band filter, maintaining high degree of freedom of design of the four characteristic values is difficult.

The dual band filter shown in FIG. 15 has a problem that unwanted signals in the frequency bands other than the desired pass bands cannot be adequately filtered out because the input/output transmission lines are directly connected to each other, and an additional band pass filter is needed to completely remove the signals in the unwanted frequency bands. In addition, from the viewpoint of downsizing of the filter, the dual band filter is disadvantageous because transmission lines of certain lengths are connected to each other at the ends.

An object of the present invention is to provide a dual band filter that solves the problems of the prior art described above, more specifically, a dual band filter that has high degree of freedom of design of a total of four characteristic values, that is, the center frequencies and bandwidths for two pass bands, is capable of substantially removes unwanted signals in the frequency bands other than desired pass bands, and can be downsized.

Means to Solve the Issues

A resonator according to the present invention comprises a signal input/output line, a first resonating part, a second resonating part and a connecting line.

The signal input/output line is used for input and output of a signal. The first resonating part is connected to the signal input/output line at one end and is opened at the other end. The second resonating part is connected to a ground conductor at one end and is opened at the other end. The connecting line has a predetermined length and connects a point of connection between the signal input/output line and the first resonating part and a predetermined point on the second resonating part.

Effects of the Invention

A dual band filter can be provided that can be adjust the center frequency and the bandwidth, which is determined by the external coupling between the signal input/output line and the resonator, for each of the two pass bands to any values without decreasing the degree of freedom of setting of the values, can effectively remove unwanted signals in the frequency bands other than the desired pass bands, and can be downsized.

BEST MODES FOR CARRYING OUT THE INVENTION

First Embodiment

Figure 1:
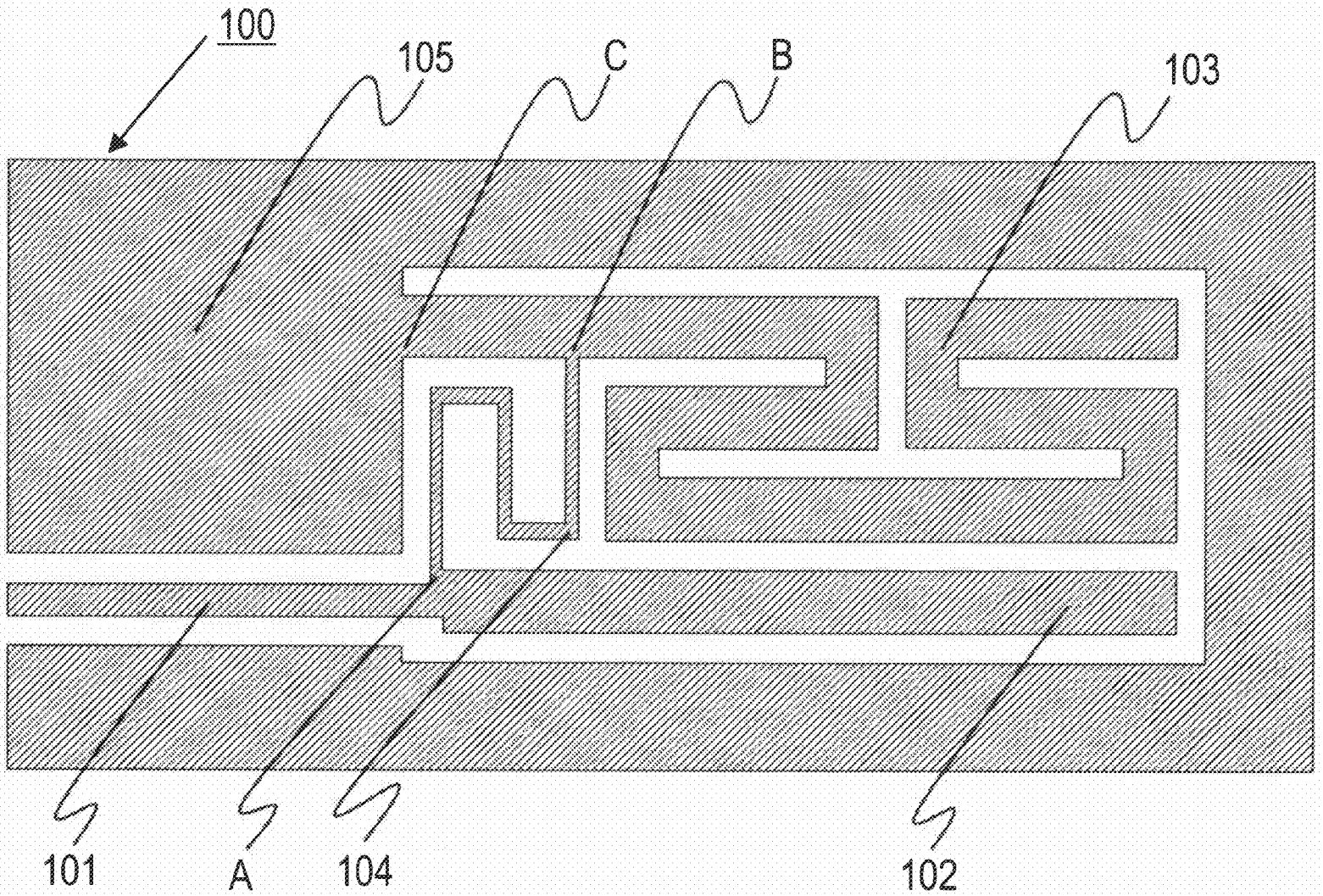
FIG. 1 is a plan view showing a configuration of a resonator according to a first embodiment.

FIG. 1 shows a configuration of a resonator according to a first embodiment. In this drawing, the shaded parts represent regions covered with a conductor, and the white parts outlined by the shaded parts represent regions in which a dielectric substrate below the conductor is exposed. The same holds true for all the drawings described below.

A resonator 100 has a signal input/output line 101, a first resonating part 102, a second resonating part 103 and a first connecting line 104 and is formed in a coplanar plane circuit having ground conductors on the opposite sides thereof.

The signal input/output line 101 is used for signal input and output. The first resonating part 102 is connected to the signal input/output line 101 at one end and is opened at the other end. The second resonating part 103 is connected at one end to the ground conductor 105 at a point of connection C and is opened at the other end. The first resonating part 102 and the second resonating part 103 have different resonance frequencies. The first connecting line 104 is connected to a point of connection A between the signal input/output line 101 and the first resonating part 102 at one end and is connected to a predetermined point of connection B on the second resonating part 103 at the other end.

In the configuration shown in FIG. 1, the second resonating part 103 shown in the upper part of the drawing is bent, so that the second resonating part 103 is longer than the first resonating part shown in the lower part of the drawing. Therefore, the second resonating part 103 resonates at a lower frequency than the first resonating part 102, and the first resonating part 102 resonates at a higher frequency than the second resonating part 103.

Since the first resonating part 102 and the second resonating part 103 are disposed close to each other and connected to each other by the first connecting line 104, the two resonating parts are inductively excited. With such a configuration, the external coupling that determines the bandwidth of the pass band of the second resonating part can be adjusted by changing the path length BC (the distance from the point of connection B to the point of connection C) by changing the position of the point of connection B between the first connecting line 104 and the second resonating part 103. Similarly, the external coupling that determines the bandwidth of the pass band of the first resonating part can be adjusted by changing the path length ABC (the distance from the point of connection A to the point of connection C via the point of connection B) by changing the length AB (the distance from the point of connection A to the point of connection B) of the first connecting line 104.

As described above, the bandwidths of the two pass bands can be adjusted by appropriately changing the path lengths BC and ABC. In addition, the center frequencies of the two pass bands can also be adjusted by changing the shape of the first and second resonating parts.

Modification

Figure 2:
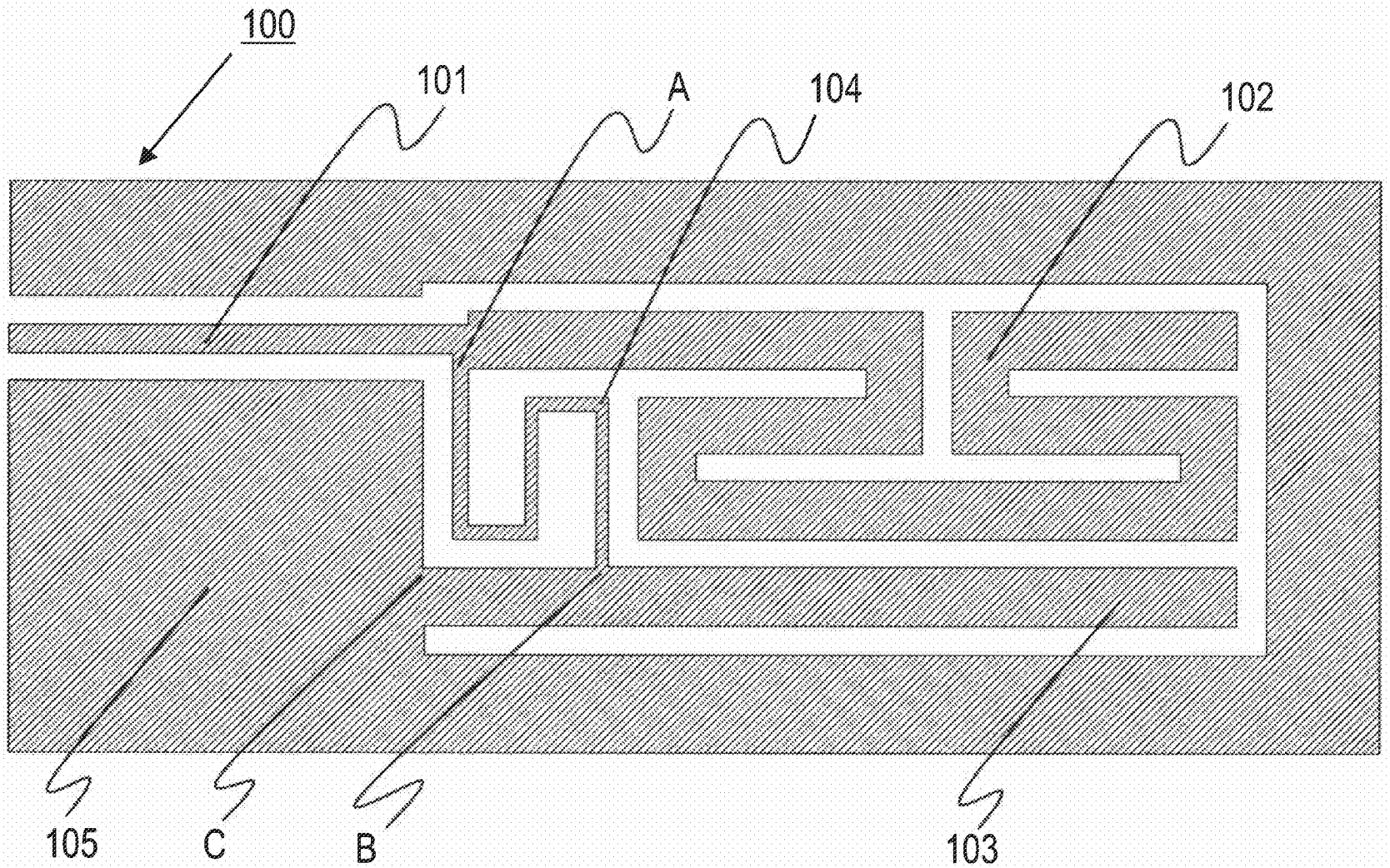
FIG. 2 is a plan view showing a modification of the resonator according to the first embodiment.

FIG. 2 shows a modification of the resonator according to the first embodiment.

In the configuration shown in FIG. 1, the second resonating part 103 is bent and therefore is longer than the first resonating part 102, which has a straight shape. To the contrary, in FIG. 2, the first resonating part 102 is bent and therefore is longer than the second resonating part 103, which has a straight shape. Regardless of which resonating part is longer, the same effects can be achieved except that the resonating part having the higher (or lower) resonance frequency changes. Therefore, the resonator 100 can have any of these configurations depending on the circumstances at the time of implementation.

Second Embodiment

Figure 3:
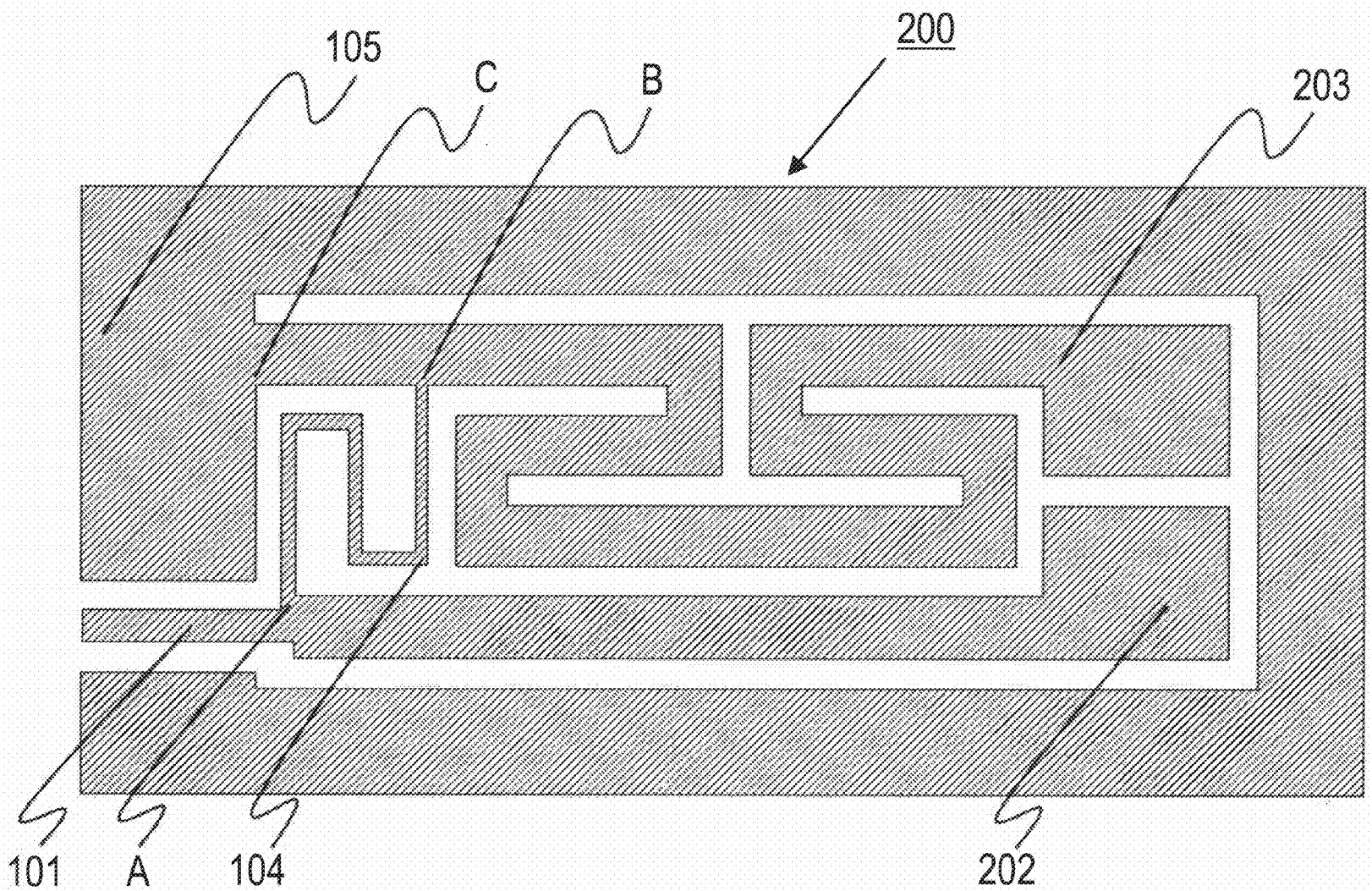
FIG. 3 is a plan view showing a configuration of a resonator according to a second embodiment.

FIG. 3 shows a configuration of a resonator according to a second embodiment.

A resonator 200 is composed of a signal input/output line 101, a first resonating part 202, a second resonating part 203 and a first connecting line 104. The signal input/output line 101 and the first connecting line 104 are the same as those in the embodiment 1 described above. In this way, of the parts shown in FIG. 3, those having the same name and the same function as those shown in FIG. 1 are denoted by the same reference numerals, and descriptions thereof will be omitted. The same holds true for the other drawings.

The first resonating part 202 and the second resonating part 203 are the same as the first resonating part 102 and the second resonating part 103 according to the first embodiment, respectively, in that the first resonating part 202 is connected to the signal input/output line 101 at one end and is opened at the other end, the second resonating part 203 is connected at one end to a ground conductor 105 at a point of connection C and is opened at the other end, and the first resonating part 202 and the second resonating part 203 have different resonance frequencies.

However, in the second embodiment, at least one of the first resonating part 202 and the second resonating part 203 has a stepped impedance structure in which the line width at the open end is wider than the line width at the other end.

The stepped impedance structure allows the electrical length of the resonator to be increased without increasing the physical length of the resonator when changing the center frequencies of the two pass bands is required, and therefore, the resonator can be downsized. In addition, the center frequencies can be flexibly adjusted by changing the length and the width of the stepped impedance structure.

In this embodiment also, as described above with reference to the modification of the first embodiment, any of the first resonating part and the second resonating part can be longer than the other.

Third Embodiment

Figure 4:
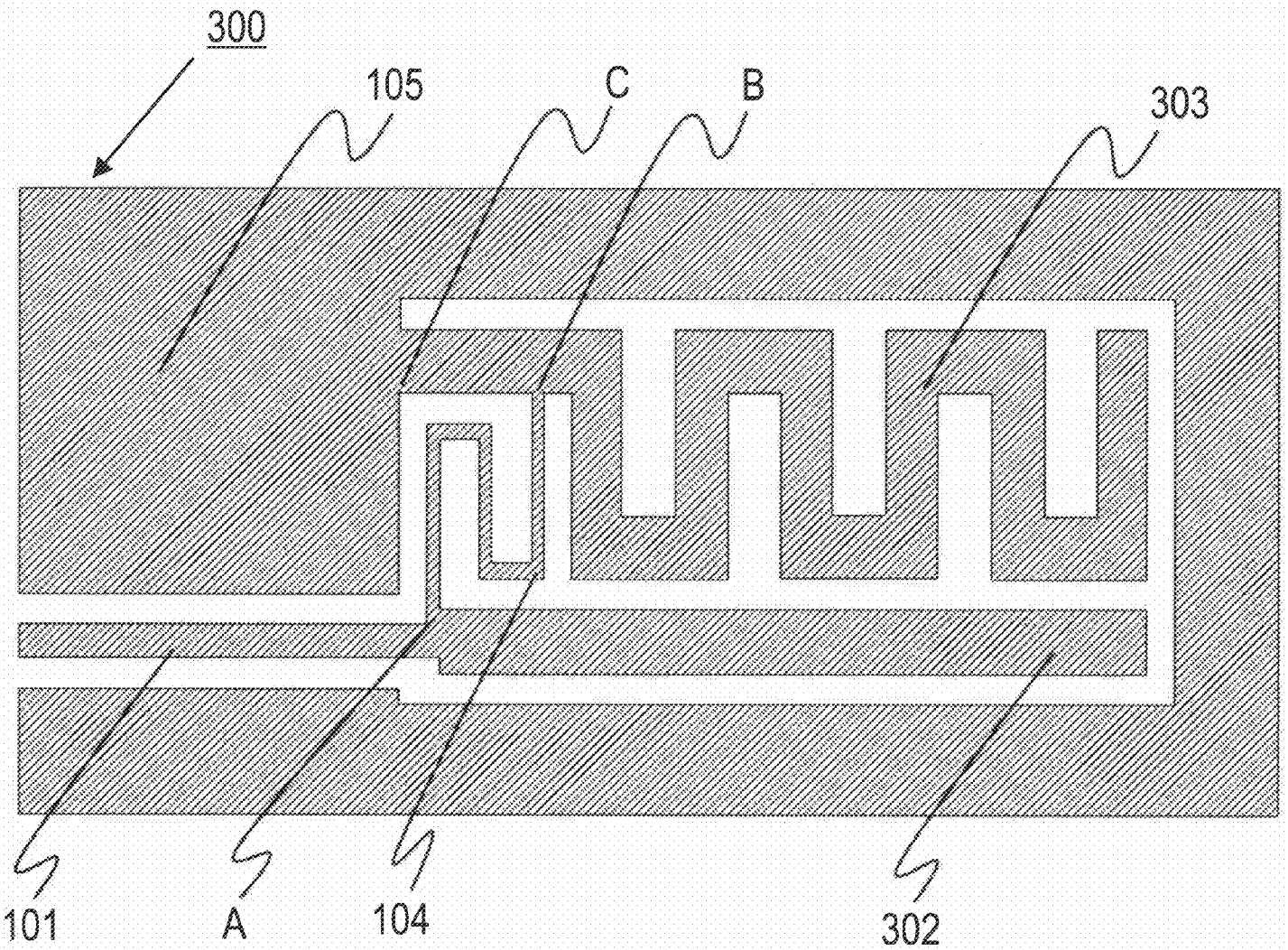
FIG. 4 is a plan view showing a configuration of a resonator according to a third embodiment.

FIG. 4 shows a configuration of a resonator according to a third embodiment.

A resonator 300 is composed of a signal input/output line 101, a first resonating part 302, a second resonating part 303 and a first connecting line 104. The signal input/output line 101 and the first connecting line 104 are the same as those according to the first embodiment described above.

The first resonating part 302 and the second resonating part 303 are the same as the first resonating part 102 and the second resonating part 103 according to the first embodiment, respectively, in that the first resonating part 302 is connected to the signal input/output line 101 at one end and is opened at the other end, the second resonating part 303 is connected at one end to a ground conductor 105 at a point of connection C and is opened at the other end, and the first resonating part 302 and the second resonating part 303 have different resonance frequencies.

However, in the third embodiment, at least one of the first resonating part 302 and the second resonating part 303 has a meandering structure in which the resonating part is folded a plurality of times. FIG. 4 shows an example in which only the second resonating part 303 has the meandering structure.

The resonating part having the meandering structure can be longer without increasing the outside dimensions. Therefore, the resonator can be downsized.

In this embodiment also, as described above with reference to the modification of the first embodiment, any of the first resonating part and the second resonating part can be longer than the other.

Fourth Embodiment

Figure 5:
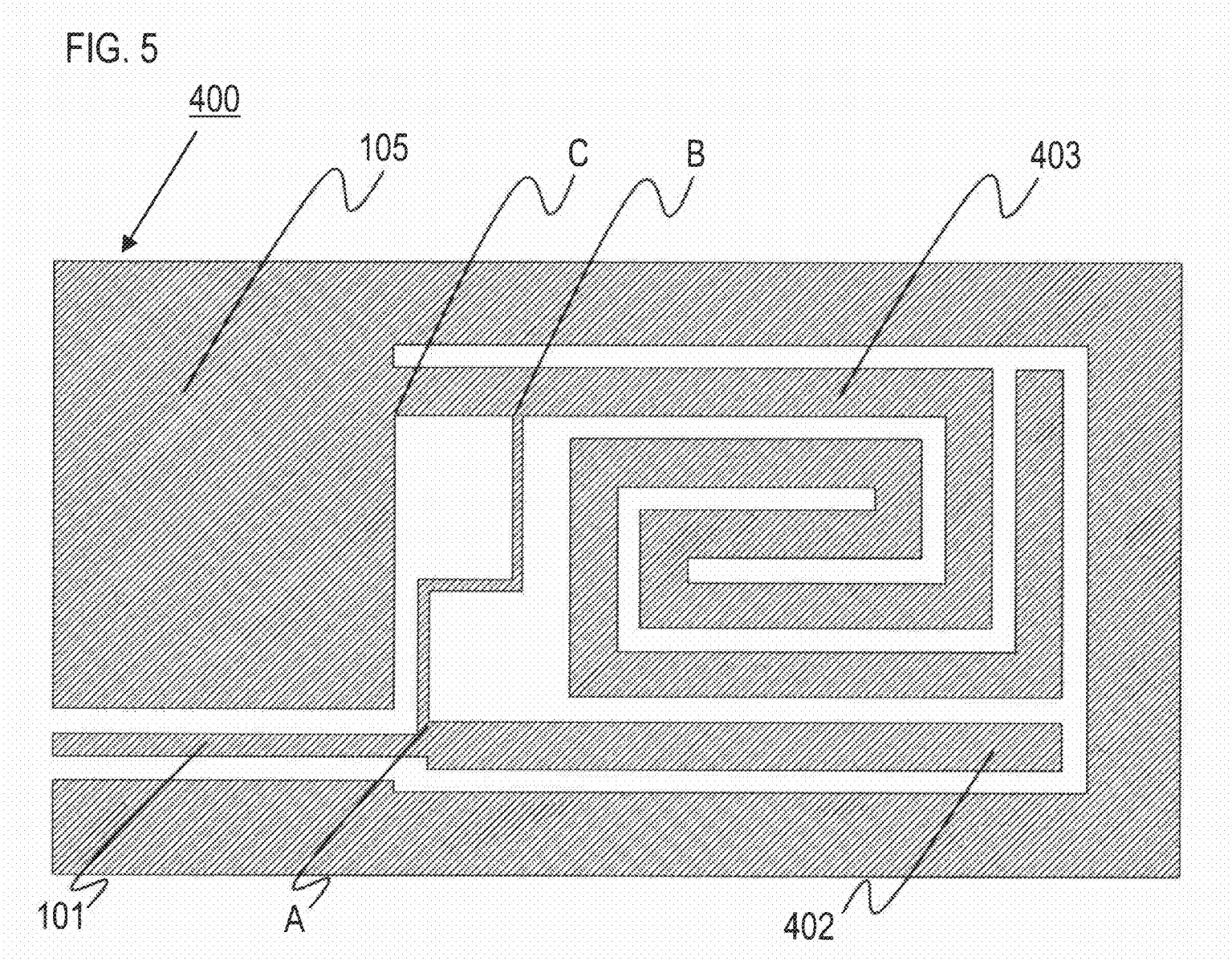
FIG. 5 is a plan view showing a configuration of a resonator according to a fourth embodiment.

FIG. 5 shows a configuration of a resonator according to a fourth embodiment.

A resonator 400 is composed of a signal input/output line 101, a first resonating part 402, a second resonating part 403 and a first connecting line 104. The signal input/output line 101 and the first connecting line 104 are the same as those according to the first embodiment described above.

The first resonating part 402 and the second resonating part 403 are the same as the first resonating part 102 and the second resonating part 103 according to the first embodiment, respectively, in that the first resonating part 402 is connected to the signal input/output line 101 at one end and is opened at the other end, the second resonating part 403 is connected at one end to a ground conductor 105 at a point of connection C and is opened at the other end, and the first resonating part 402 and the second resonating part 403 have different resonance frequencies.

However, in the fourth embodiment, at least one of the first resonating part 402 and the second resonating part 403 has a folded spiral structure. FIG. 5 shows an example in which only the second resonating part 403 has the folded spiral structure.

As in the third embodiment, the resonating part having the folded spiral structure can be longer without increasing the outside dimensions, and therefore, the resonator can be downsized.

In this embodiment also, as described above with reference to the modification of the first embodiment, any of the first resonating part and the second resonating part can be longer than the other.

Fifth Embodiment

Figure 6:
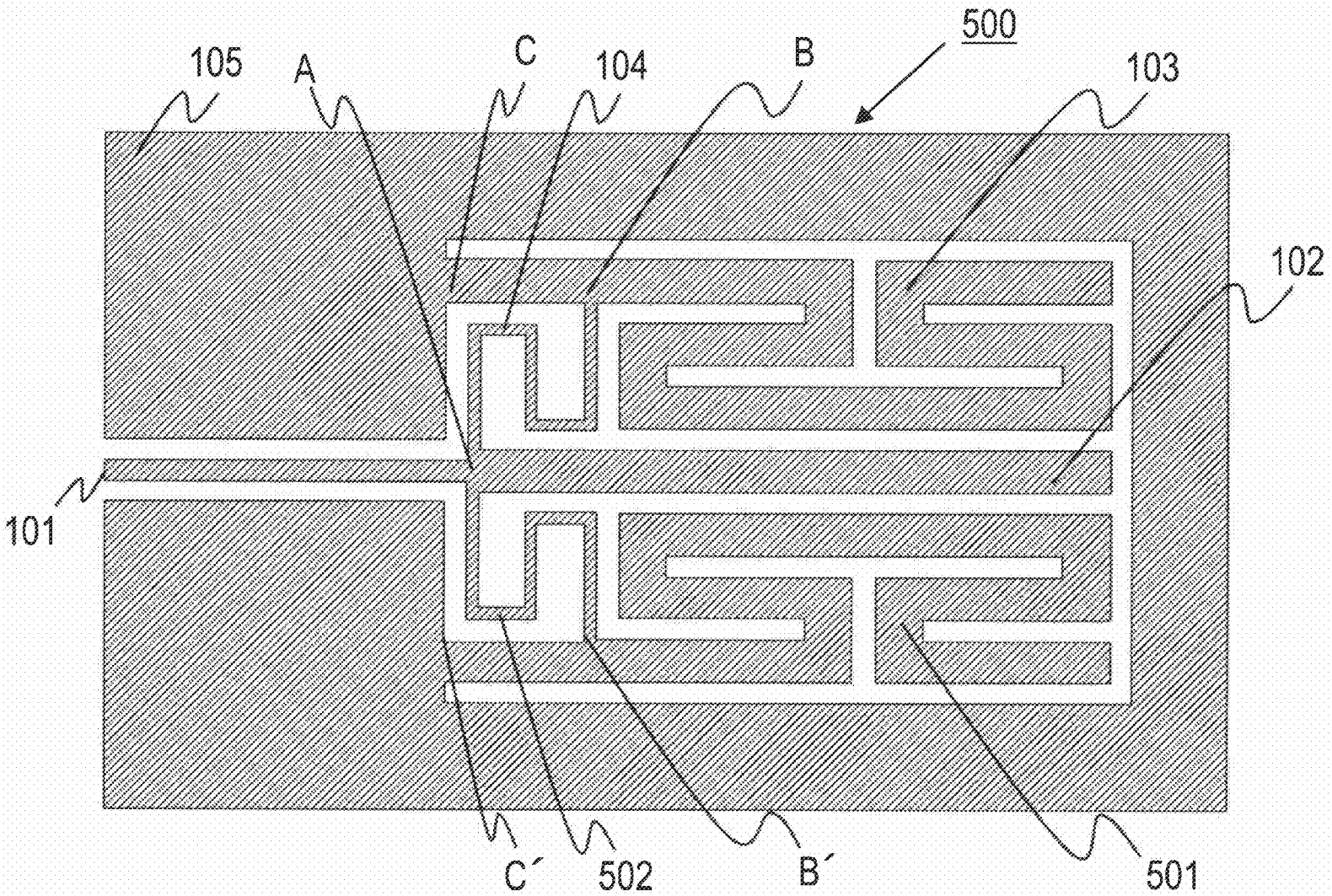
FIG. 6 is a plan view showing a configuration of a resonator according to a fifth embodiment.

FIG. 6 shows a configuration of a resonator according to a fifth embodiment.

A resonator 500 is composed of a signal input/output line 101, a first resonating part 102, a second resonating part 103, a first connecting line 104, a third resonating part 501 and a second connecting line 502. The signal input/output line 101, the first resonating part 102, the second resonating part 103 and the first connecting line 104 are the same as those according to the first embodiment described above. The first resonating part can have any shape symmetrical with respect to the longitudinal center axis of the signal input/output line, such as the rectangular shape shown in FIG. 6 and the shape of the stepped impedance structure. The second resonating part can have any of the shapes according to the first to fourth embodiments described above.

The third resonating part 501 is connected at one end to a ground conductor 105 at a point of connection C' and is opened at the other end. The second connecting line 502 is connected to a point of connection A between the signal input/output line 101 and the first resonating part 102 at one end and is connected to a predetermined point of connection B' on the third resonating part 501 at the other end.

The third resonating part 501 and the second connecting line 502 are shaped and positioned symmetrically to the second resonating part 103 and the first connecting line 104, respectively, with respect to the longitudinal center axis of the signal input/output line 101. The second resonating part 103 and the third resonating part 501 symmetrically positioned integrally resonate at the same frequency, and thus, the first resonating part and the pair of the second and third resonating parts serve as a resonator having two pass bands.

With such a configuration, the circuit has a line-symmetric structure with respect to the symmetric axis. Therefore, the calculation amount and the calculation time for an electromagnetic simulation can be reduced, and an unwanted asymmetric resonance mode can be suppressed to substantially remove unwanted signals in the frequency bands other than the desired pass bands.

Figure 7:
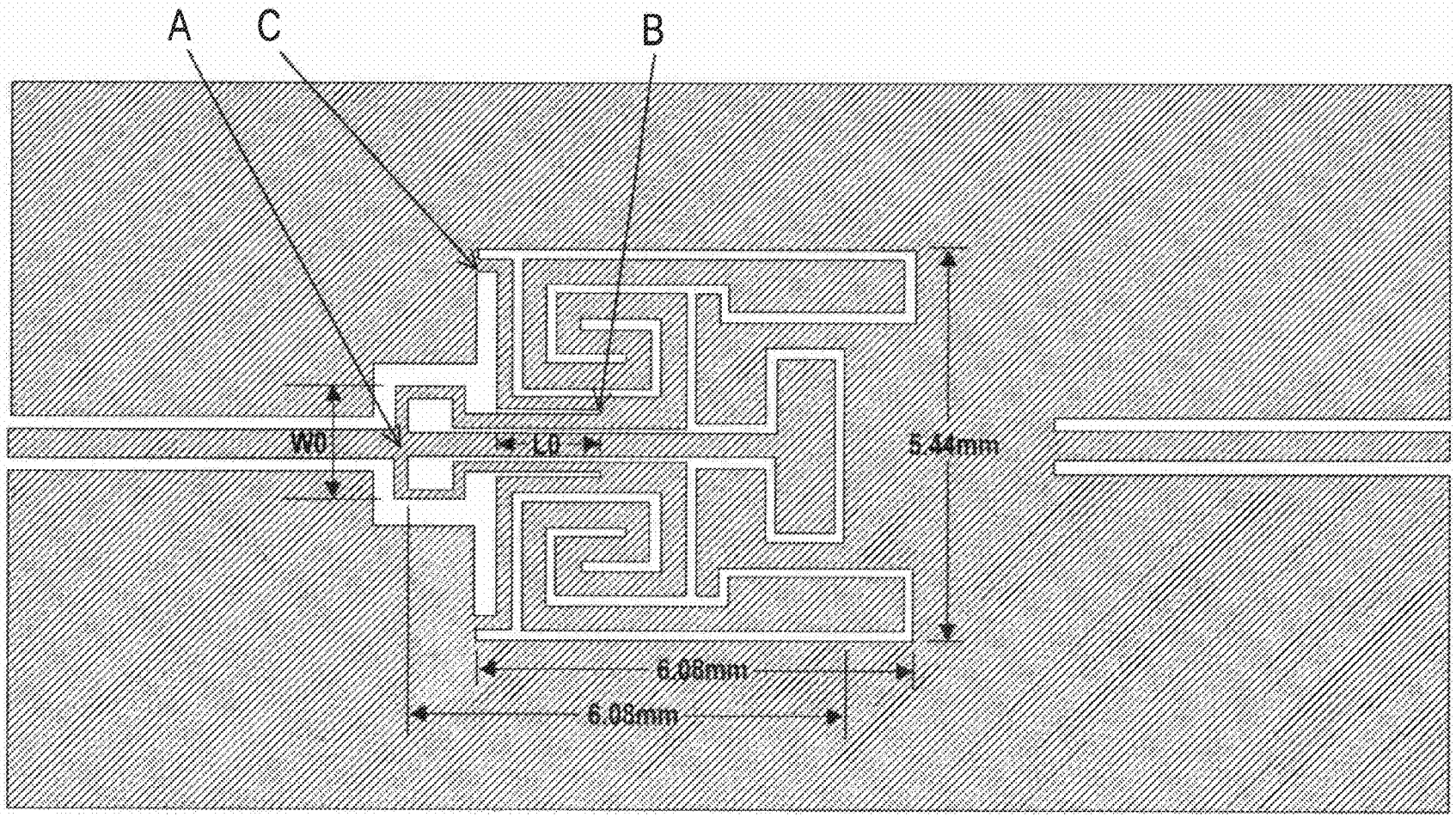
FIG. 7 is a plan view showing a configuration used for a characteristics simulation in the fifth embodiment.
Figure 8:
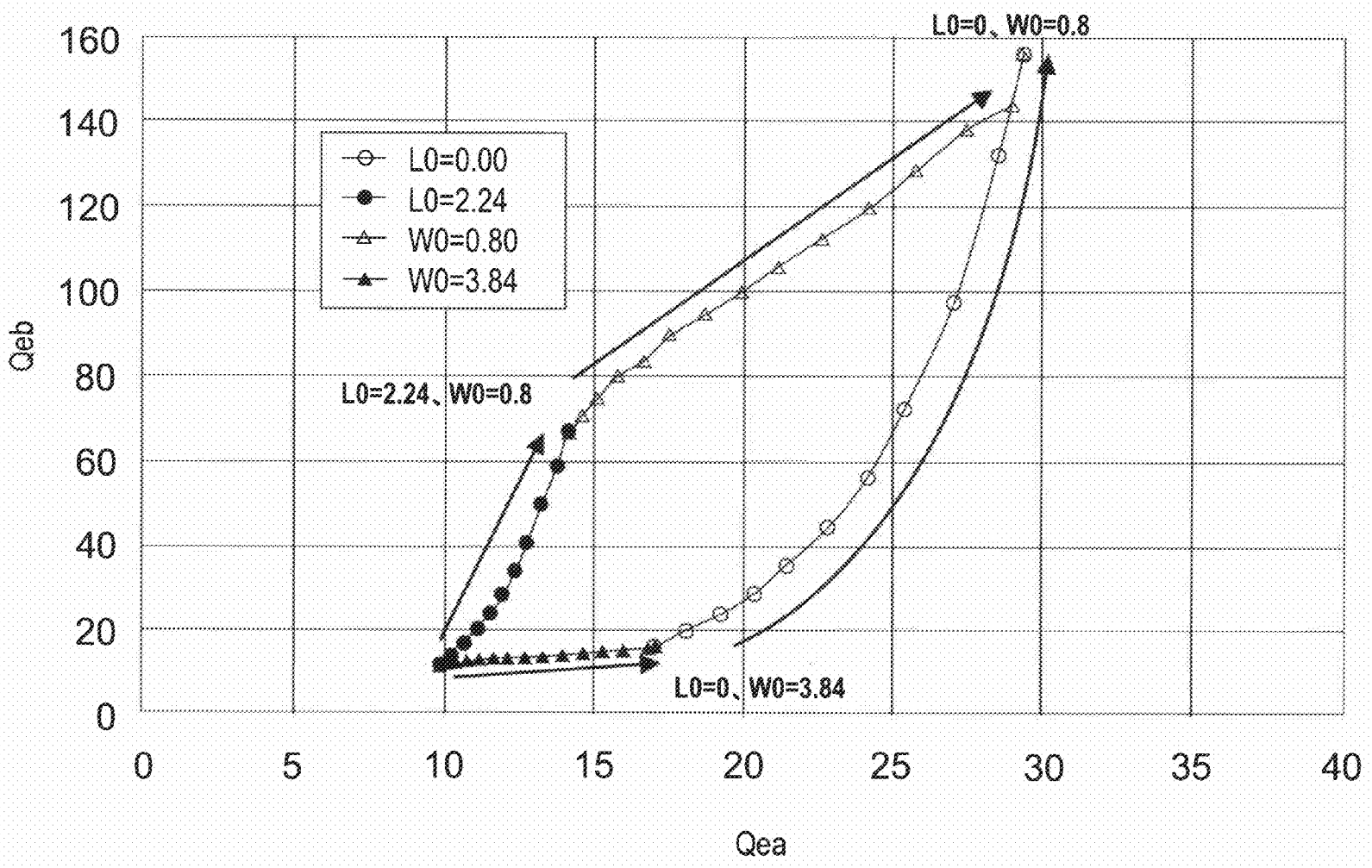
FIG. 8 is a graph showing the results of the characteristics simulation in the fifth embodiment.

FIG. 8 shows the results of a simulation of the external coupling for various path lengths BC and various path lengths ABC in the configuration shown in FIG. 7.

In the configuration shown in FIG. 7, the first resonator has a stepped impedance structure at the open end thereof, and the second resonating part and the third resonating part also have a stepped impedance structure at the open ends thereof and have a spiral structure at a middle part thereof. The path length BC can be changed by adjusting the length L0, and the path length ABC can be changed also by adjusting the length W0.

In the simulation, the variation of the external coupling Qea for the pass band of the first resonating part and the variation of the external coupling Qeb for the pass band of the second resonating part were observed for four cases where (1) the length L0 was fixed at 0, and the length W0 was changed from 0.8 to 3.84, (2) the length L0 was fixed at 2.24, and the length W0 was changed from 0.8 to 3.84, (3) the length W0 was fixed at 0.8, and the length L0 was changed from 0 to 2.24, (4) the length W0 was fixed at 3.84, and the length L0 was changed from 0 to 2.24. For calculation, it was supposed that the relative dielectric constant of the dielectric substrate was 9.68, the thickness of the dielectric substrate was 0.5 mm, the height of the space above the substrate was 4.0 mm, and the height of the space below the substrate was 3.5 mm.

From the simulation results shown in FIG. 8, it can be seen that, within the range defined by the four lines, the set of the external couplings Qea and Qeb can be adjusted as desired by appropriately determining the length L0 within the range of 0 to 2.24 and the length W0 within the range of 0.8 to 3.84.

Thus, both the external couplings Qea and Qeb can be adjusted by changing the lengths L0 and W0. The larger the external couplings Qea and Qeb, the narrower the pass bands become. The smaller the external couplings Qea and Qeb, the wider the pass bands become.

In this simulation, the lengths L0 and W0 were used as parameters. However, any parameter that can be changed to change the path length BC or ABC can be used.

Sixth Embodiment

FIG. 9 show a configuration of a resonator according to a sixth embodiment.

A resonator 600 has a signal input/output line 101, a first resonating part 102, a second resonating part 103, a first connecting line 104 and a via hole 601, and the components except for the via hole 601 are the same as those according to the first embodiment described above.

The via hole 601 is a through hole formed in the substrate to provide an electrical connection between the second resonating part 103 formed on the front surface of the substrate and a ground conductor 602 formed on the back surface of the substrate.

Figures 9A, 9B:
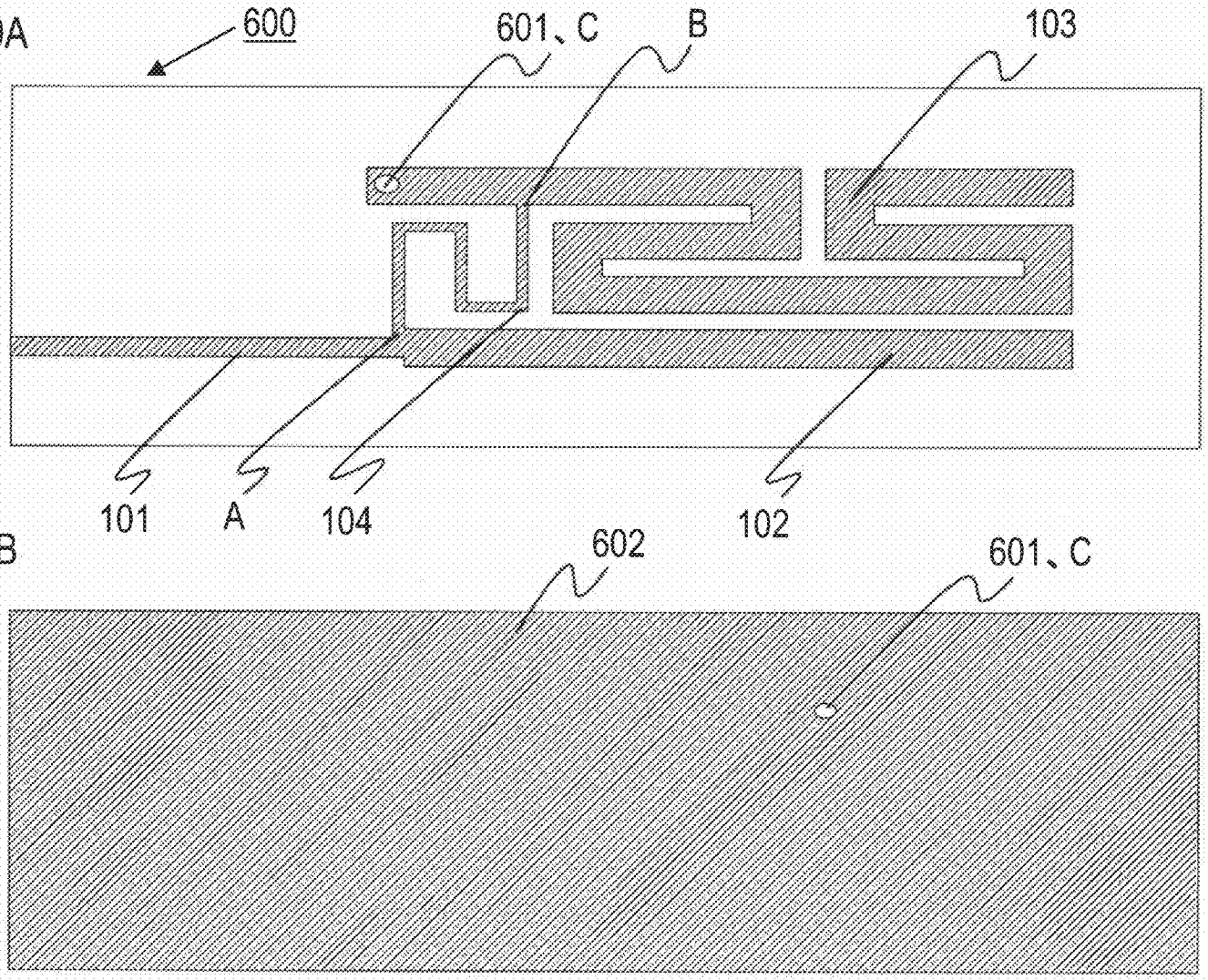
FIG. 9A shows a configuration of a front surface of a resonator according to a sixth embodiment.
FIG. 9B shows a configuration of a back surface of a resonator according to a sixth embodiment.

The resonator 100 according to the first embodiment is configured as a coplanar plane circuit having the ground conductors on the opposite sides thereof. However, the resonator 600 according to the sixth embodiment has a microstrip structure in which the circuit is formed on the front surface of the substrate (FIG. 9A), and the ground conductor 602 is formed on the back surface of the substrate (FIG. 9B).

The microstrip structure requires the via hole and the conductors on the both surfaces of the substrate. Therefore, in terms of cost, the microstrip structure is slightly disadvantageous compared with the coplanar structure, which requires the conductor on only one surface of the substrate. However, since the whole of the ground conductor is disposed on the back surface of the substrate, the microstrip structure is advantageous compared with the coplanar structure in that a line for an additional function can be easily added at the side of the resonator without significantly affecting the characteristics of the original circuit.

Similarly, the resonators according to the second to fifth embodiments can have the microstrip structure.

Seventh Embodiment

A dual band filter can be formed by coupling a plurality of resonators in a multistage structure in which resonators having a configuration according to any of, or a combination of, the first to sixth embodiments are disposed at the opposite ends thereof.

Figure 10:
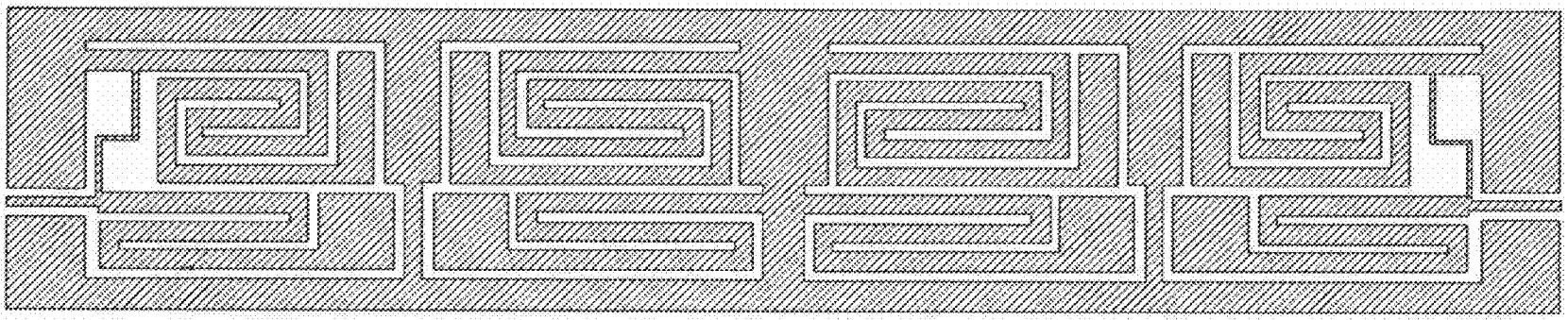
FIG. 10 is a plan view showing a configuration of a dual band filter according to a seventh embodiment.

FIG. 10 shows a configuration of a four-stage dual band filter that has, at the opposite ends thereof, resonators having a first resonating part of the meandering structure described above with reference to the third embodiment and a second resonating part of the spiral structure described above with reference to the fourth embodiment, in which the first resonating part and the second resonating part have a stepped impedance structure at the open ends thereof. With such a configuration, the filter can be downsized.

Figure 11:
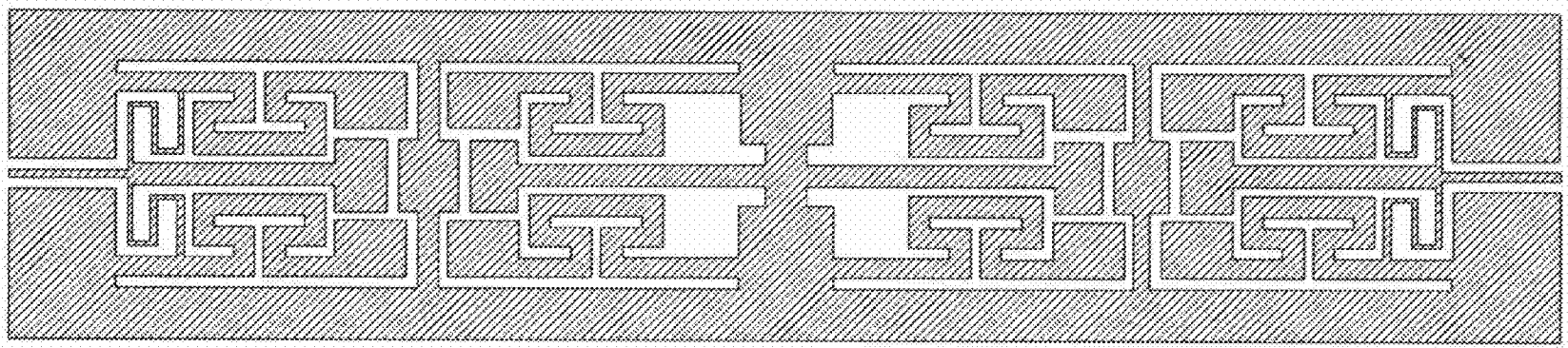
FIG. 11 is a plan view showing a configuration of another dual band filter according to the seventh embodiment.

FIG. 11 shows a configuration of a four-stage dual band filter that has, at the opposite ends thereof, resonators having the structure according to the fifth embodiment shown in FIG. 6 and the stepped impedance structure according to the second embodiment in combination. The entire circuit pattern is line-symmetrical with respect to the longitudinal axis thereof, and therefore, the calculation amount and the calculation time for the electromagnetic simulation can be reduced, and an unwanted asymmetric resonance mode can be suppressed. Furthermore, the stepped impedance structure and the meandering structure are applied to the resonators, and therefore, the filter can be downsized.

Figure 12:
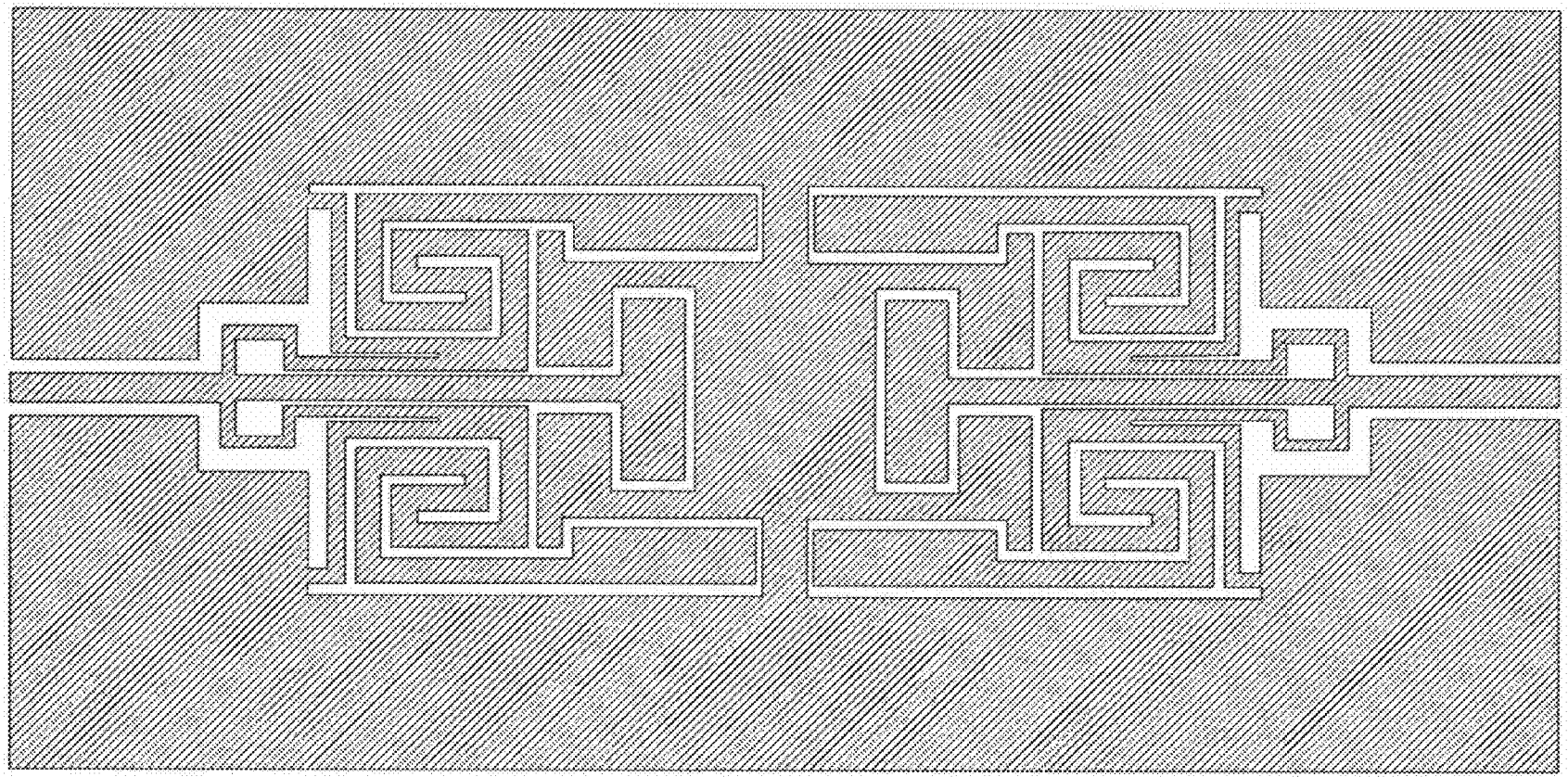
FIG. 12 is a plan view showing a configuration used for a characteristics simulation in the seventh embodiment.
Figure 13:
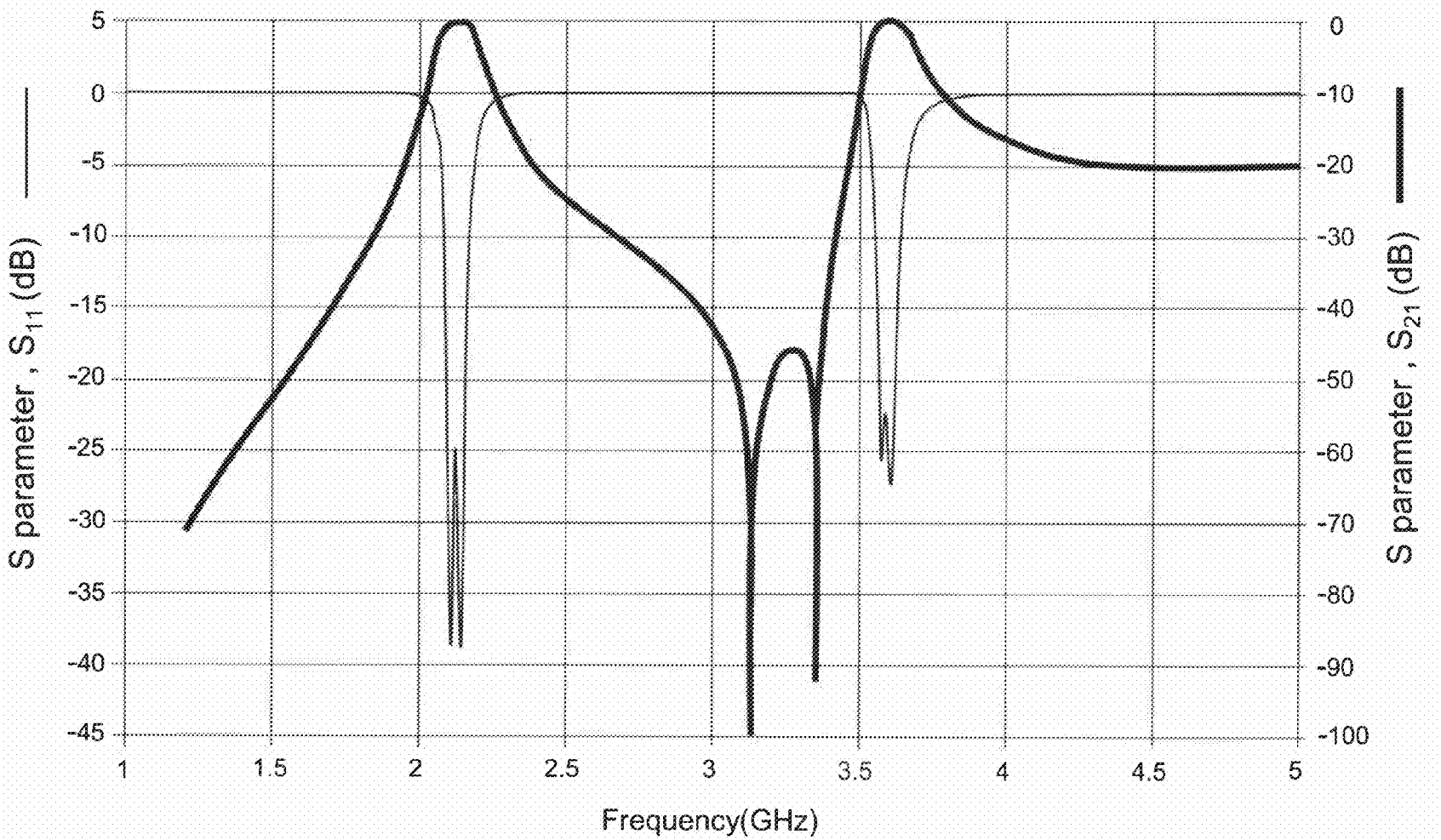
FIG. 13 is a graph showing the results of the characteristics simulation in the seventh embodiment.
Figure 14:
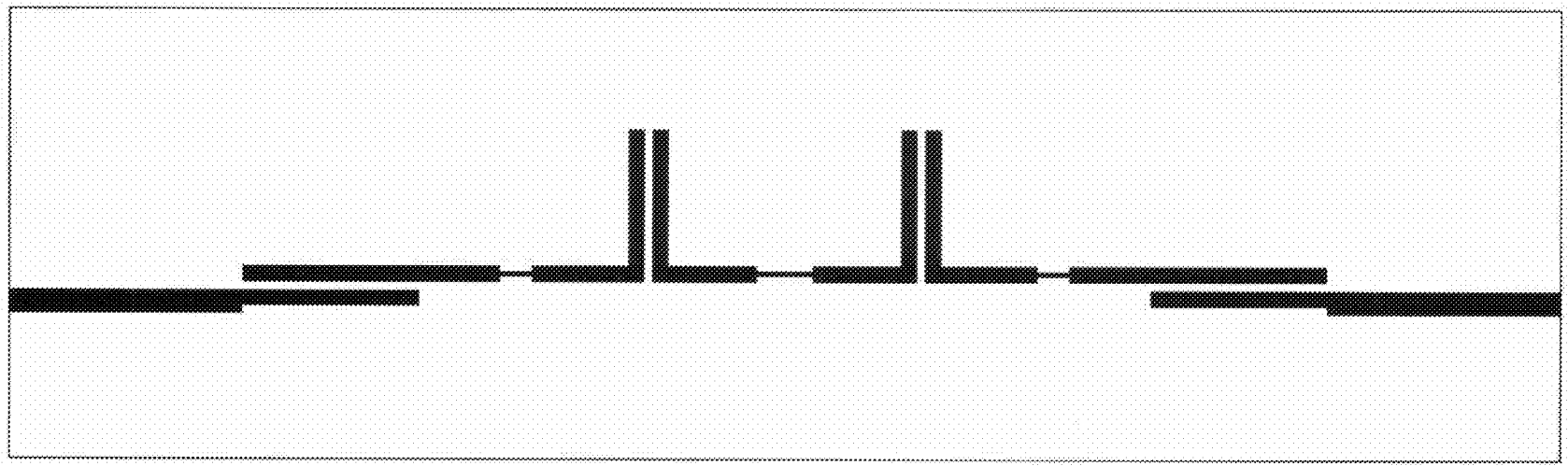
FIG. 14 is a plan view showing a configuration of a conventional dual band filter.
Figure 15:
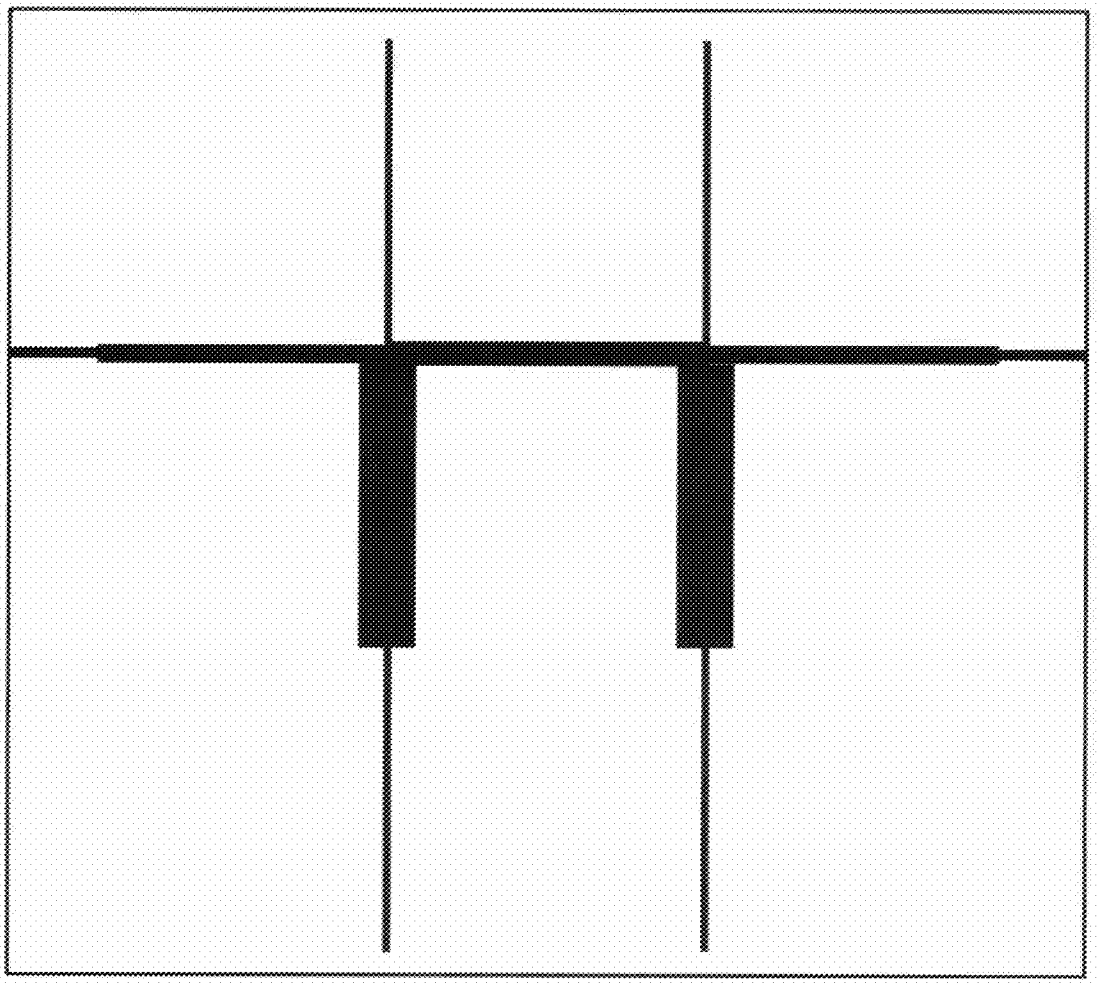
FIG. 15 is a plan view showing a configuration of another conventional dual band filter.

FIG. 13 shows the results of a simulation of the electrical characteristics of the filter having the configuration shown in FIG. 12. The filter shown in FIG. 12 is a two-stage dual band filter that has two opposed resonators that has a first resonating part having a stepped impedance structure at the open end thereof and a second resonating part and a third resonating part having a stepped impedance structure at the open end thereof and a spiral structure at a middle part thereof.

FIG. 13 shows the results of a simulation of the reflection characteristics ($S_{11}$, represented by the thin line) and the transmission characteristics ($S_{21}$, represented by the thick line) of the filter having the configuration shown in FIG. 12 for input signals at frequencies of 1 GHz to 5 GHz. From the results, it can be seen that the pass band provided by the combination of the second resonating part and the third resonating part disposed on the opposite sides appears in the vicinity of 2.1 GHz, the pass band provided by the first resonating part disposed on the center symmetric axis appears in the vicinity of 3.7 GHz, and unwanted signals in the frequency bands other than the desired pass bands can be substantially removed.

The present invention is advantageous as a component of a plane circuit for the microwave band or millimeter wave band that is configured as a dual band circuit.

What is claimed is:

1. A resonator that has two resonating parts that resonate at different frequencies, the resonator comprising:

a signal input/output line used for input and output of a signal;

a first resonating part that is connected to said signal input/output line at one end and is opened at the other end;

a second resonating part that is connected to a ground conductor at one end and is opened at the other end; and a first connecting line that has a predetermined length and is connected to a point of connection between said signal input/output line and said first resonating part at one end and is connected to a predetermined point on said second resonating part at the other end.

2. The resonator according to claim 1, wherein at least one of said first resonating part and said second resonating part has a stepped impedance structure in which the line width at the open end thereof is wider than the line width at the other end thereof.

3. The resonator according to claim 1, wherein at least one of said first resonating part and said second resonating part has a meandering structure.

4. The resonator according to claim 1, wherein at least one of said first resonating part and said second resonating part has a spiral structure.

5. The resonator according to claim 1, wherein a longitudinal center axis of said signal input/output line is regarded as a symmetric axis, and the resonator further comprises:

a third resonating part that is shaped and positioned symmetrically to said second resonating part with respect to said symmetric axis; and a second connecting line that is shaped and positioned symmetrically to said first connecting line with respect to said symmetric axis.

6. The resonator according to claim 1, wherein said first resonating part and said second resonating part are concurrently inductively excited.

7. The resonator according to claim 5, wherein said first resonating part, said second resonating part and said third resonating part are concurrently inductively excited.

8. The resonator according to claim 1, wherein the resonator is formed in a coplanar plane circuit having ground conductors on the opposite sides thereof.

9. The resonator according to claim 1, wherein the resonator has a microstrip structure in which a ground conductor is disposed on a back surface of a substrate.

10. A dual band filter that has a resonator according to claim 1.

* * * * *